US009962044B1

(12) United States Patent
Ovokaitys et al.

(10) Patent No.: US 9,962,044 B1
(45) Date of Patent: May 8, 2018

(54) TOUCH SCREEN WIPE DISPENSER

(71) Applicants: Daniel S. Ovokaitys, Oconomowoc, WI (US); Dawn M. Ovokaitys, Oconomowoc, WI (US)

(72) Inventors: Daniel S. Ovokaitys, Oconomowoc, WI (US); Dawn M. Ovokaitys, Oconomowoc, WI (US)

( * ) Notice: Subject to any disclaimer, the term of this patent is extended or adjusted under 35 U.S.C. 154(b) by 395 days.

(21) Appl. No.: 14/880,593

(22) Filed: Oct. 12, 2015

(51) Int. Cl.

| | |
|---|---|
| ***A47K 10/38*** | (2006.01) |
| ***B65H 16/00*** | (2006.01) |
| ***A47L 25/00*** | (2006.01) |
| ***A47K 10/22*** | (2006.01) |

(52) U.S. Cl.
CPC ..... *A47K 10/38* (2013.01); *A47K 10/22* (2013.01); *A47L 25/00* (2013.01); *B65H 16/005* (2013.01)

(58) Field of Classification Search
CPC ..... B65H 16/005; A47K 10/22; A47K 10/38; A47L 25/00
USPC ..... 242/598.6, 588–588.3, 405, 405.3
See application file for complete search history.

(56) References Cited

U.S. PATENT DOCUMENTS

| | | | | |
|---|---|---|---|---|
| 837,939 | A * | 12/1906 | Livermore | B65H 35/0026 206/39 |
| 870,445 | A * | 11/1907 | Livermore | B65D 83/0805 206/39 |
| 3,647,059 | A * | 3/1972 | Humphreys | G02C 11/00 15/214 |
| 4,989,801 | A * | 2/1991 | Thomas | B42D 19/00 206/407 |
| 7,431,526 | B2 * | 10/2008 | Lin | B43K 29/12 242/550 |
| D630,010 | S * | 1/2011 | Brown | D3/208 |
| 8,517,171 | B1 | 8/2013 | Delgado | |
| 8,783,601 | B1 * | 7/2014 | Shala | A47K 10/16 242/596.8 |

* cited by examiner

*Primary Examiner* — William E Dondero
(74) *Attorney, Agent, or Firm* — Donald J. Ersler

(57) ABSTRACT

A touch screen wipe dispenser preferably includes a wipe retainer, a wipe roll and a wipe cover. The wipe retainer preferably includes a wipe cylindrical tube and a key ring hook that extends from one end of the wipe cylindrical tube. A retainer wipe slot is formed through a length of the wipe cylindrical tube. The wipe roll includes a plurality of wipe sheets. The wipe roll is inserted into the wipe cylindrical tube and also extends through the retainer wipe slot. The wipe cover includes a cover cylindrical tube and a twist cap that terminates one end of the cover cylindrical tube. A cover wipe slot is formed through a length of the cover cylindrical tube. A user extracts a wipe sheet from the screen wipe dispenser by rotating the twist cap relative to the key hook ring, such that the pull wipe feeds outward.

20 Claims, 6 Drawing Sheets

TOUCH SCREEN WIPE DISPENSER

BACKGROUND OF THE INVENTION

1. Field of the Invention

The present invention relates generally to electronic mobile touch screen devices and more specifically to a touch screen wipe dispenser, which is small enough to be retained on car key ring.

2. Discussion of the Prior Art

U.S. Pat No. 8,517,171 to Delgado discloses a holding device for antibacterial wipes and gel.

Accordingly, there is a clearly felt need in the art for a touch screen wipe dispenser, which is small enough to be retained on a car key ring and is about the length of a car key.

SUMMARY OF THE INVENTION

The present invention provides a touch screen wipe dispenser, which is about the length of a car key. The touch screen wipe dispenser preferably includes a wipe retainer, a wipe roll and a wipe cover. The wipe retainer preferably includes a wipe cylindrical tube and a key ring hook. The key ring hook extends from one end of the wipe cylindrical tube. A ring gap is created between an end of the wipe retainer and an end of the key ring hook. The ring gap is sized to be smaller than a perimeter of a typical key ring. A retainer wipe slot is formed through a side wall of substantially all of a length of the wipe cylindrical tube. A pair of guide projections extend from an edge of said retainer wipe slot at substantially opposing ends of the wipe cylindrical tube. A pair of projection clearance slots are formed in an opposing edge of the retainer wipe slot inline with the pair of guide projections. A distance between each guide projection is greater than a width of the wipe roll. A retainer snap groove is formed around substantially all of a perimeter of an opposing end of the wipe cylindrical tube. Each end of the retainer snap groove stops short of communicating with the retainer wipe slot. A stop projection extends outward from a bottom of the retainer snap groove at substantially one end of the retainer snap groove. The stop projection is spaced from the retainer snap groove to create a lock cavity.

The wipe roll includes a plurality of wipe sheets separated by a series of perforations. The shape of each wipe sheet includes a pull portion, which extends from a wipe base. The pull portion is located in a middle of the wipe base. A distance between the pair of guide projections is greater than a width of the pull portion. The wipe cover includes a cover cylindrical tube and a twist cap. One end of the cover cylindrical tube is terminated with the twist cap. A cover wipe slot is formed through substantially all of a length of the cover cylindrical tube. A wipe cover portion is formed adjacent the cover cylindrical tube. An inner width of the wipe cover portion is sized to be wider than a width of the pull portion. An inner height of the wipe cover portion is sized to have a greater height than a thickness of a wipe sheet of the wipe roll. A cover snap groove is formed in an inner perimeter of the twist cap. The cover snap groove is aligned to communicate with the retainer snap groove. A lock projection extends from a bottom of the cover snap groove.

In use, the wipe roll is inserted into the wipe retainer. The pull portion is inserted through the retainer wipe slot. The wipe retainer with the wipe roll is aligned with the wipe cover, such that the pull portion may be full inserted into the cover wipe slot. To extract a wipe sheet from the screen wipe dispenser, the user grasps the key hook ring and rotates the twist cap relative to the key hook ring, such that the pull portion feeds outward. The pull portion is pulled from the touch screen wipe dispenser, which advances the wipe roll for another wipe sheet. The wipe cover may be rotated relative to the wipe retainer, such that that pull portion is covered. The lock projection of the twist cap will be rotated into the lock cavity of the retainer snap groove.

Accordingly, it is an object of the present invention to provide a touch screen wipe dispenser, which is small enough to be retained on a car key ring.

Finally, it is another object of the present invention to provide a touch screen wipe dispenser, which is about the length of a car key.

These and additional objects, advantages, features and benefits of the present invention will become apparent from the following specification.

DETAILED DESCRIPTION OF THE PREFERRED EMBODIMENTS

Figure 1:
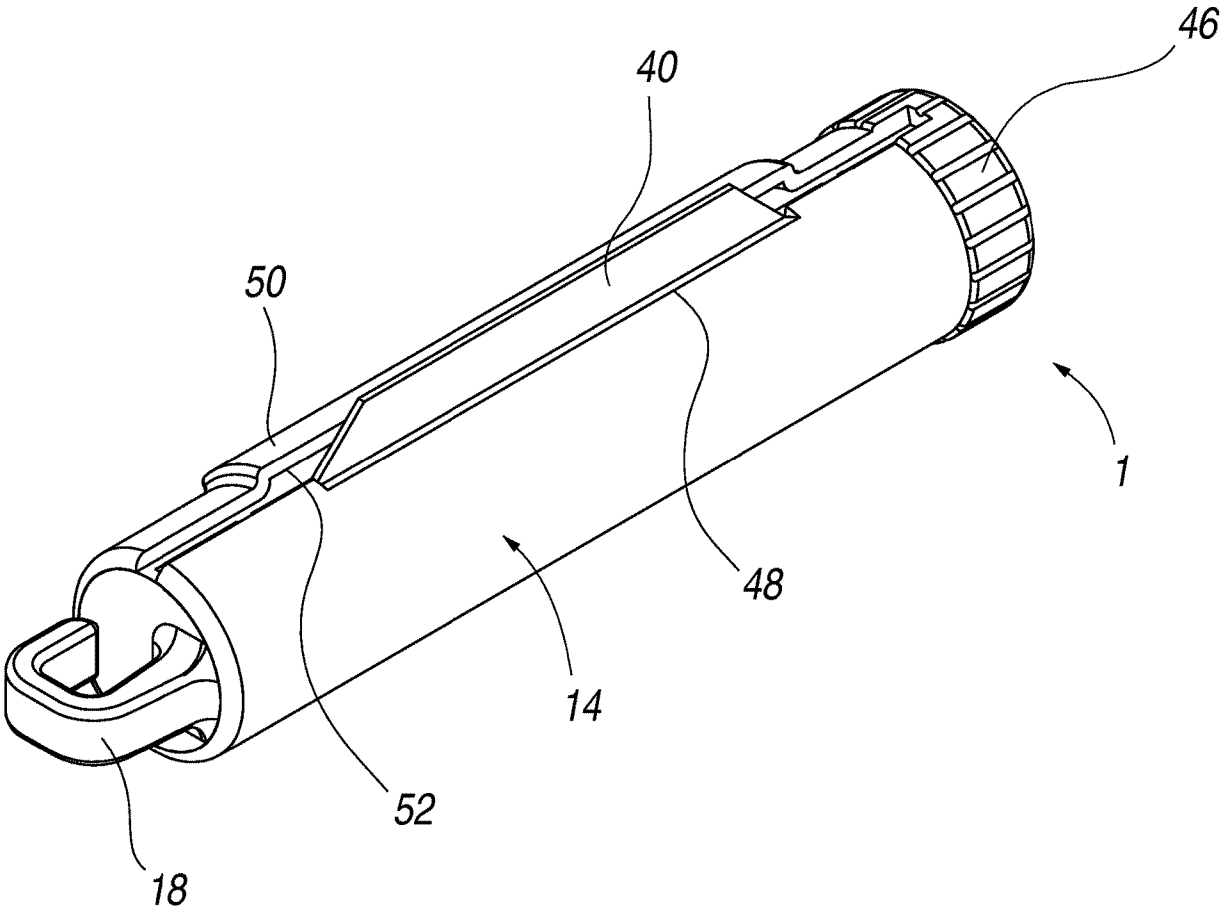
FIG. 1 is a perspective view of a touch screen wipe dispenser in accordance with the present invention.
Figure 2:
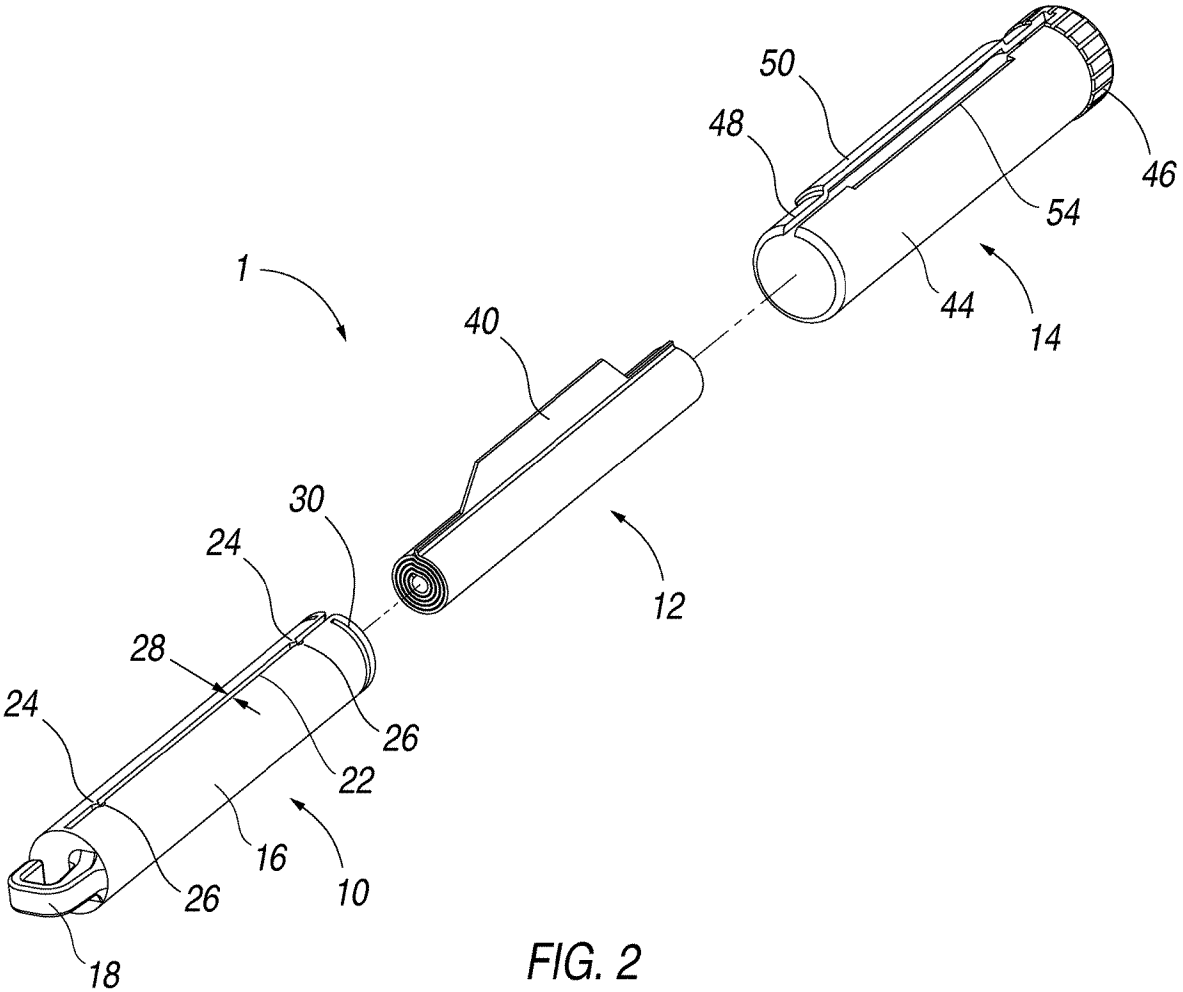
FIG. 2 is an exploded perspective view of a touch screen wipe dispenser in accordance with the present invention.
Figure 4:
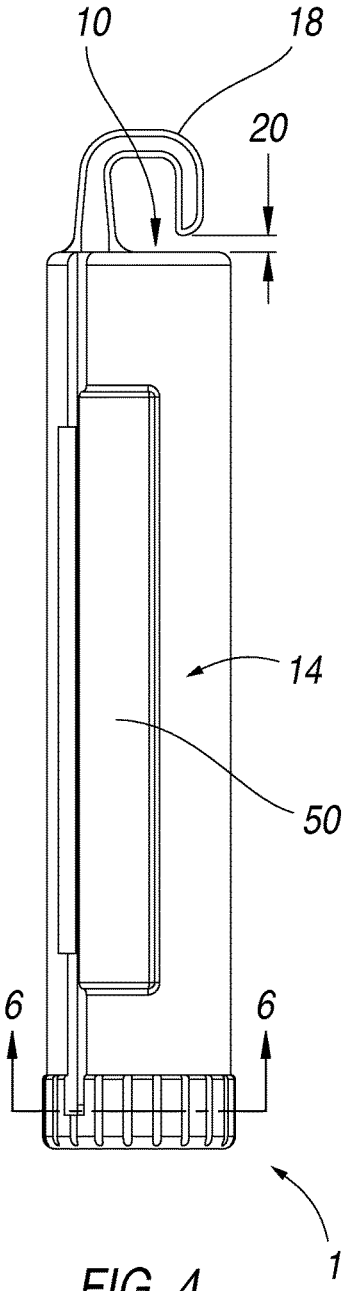
FIG. 4 is a top view of a touch screen wipe dispenser in a closed orientation in accordance with the present invention.

With reference now to the drawings, and particularly to FIG. 1, there is shown a perspective view of a touch screen wipe dispenser 1. With reference to FIG. 2, the touch screen wipe dispenser 1 preferably includes a wipe retainer 10, a wipe roll 12 and a wipe cover 14. The wipe retainer 10 preferably includes a wipe cylindrical tube 16 and a key ring hook 18. The key ring hook 18 extends from one end of the wipe cylindrical tube 16. With reference to FIG. 4, a ring gap 20 is created between an end of the wipe retainer 10 and an end of the key ring hook 18. The ring gap 20 is sized to be smaller than a perimeter of a typical key ring. A retainer wipe slot 22 is formed through a side wall of substantially all of a length of the wipe cylindrical tube 16 and substantially parallel to a lengthwise axis of the wipe cylindrical tube 16.

Figure 5:
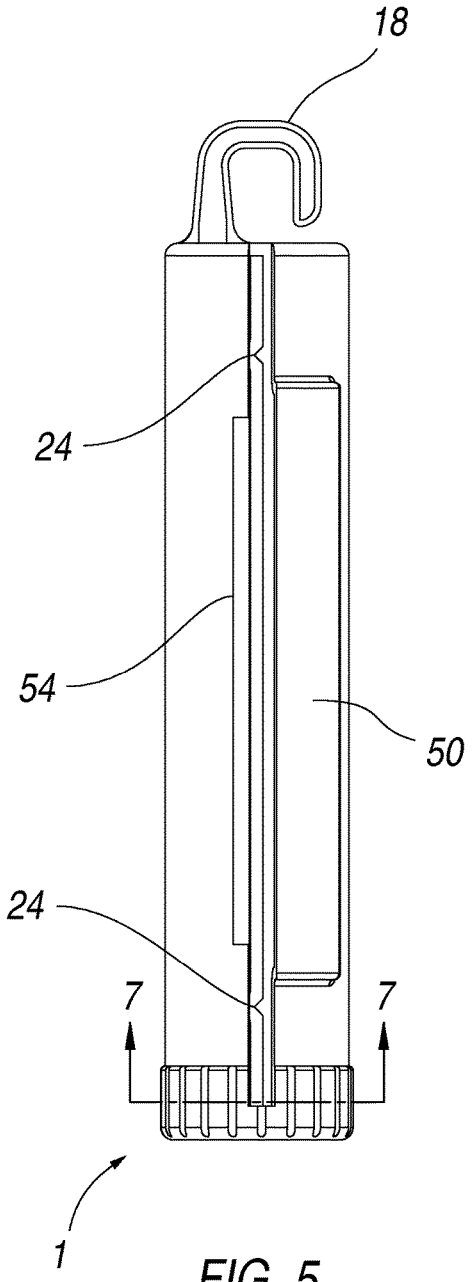
FIG. 5 is a top view of a touch screen wipe dispenser in a open orientation in accordance with the present invention.
Figure 7:
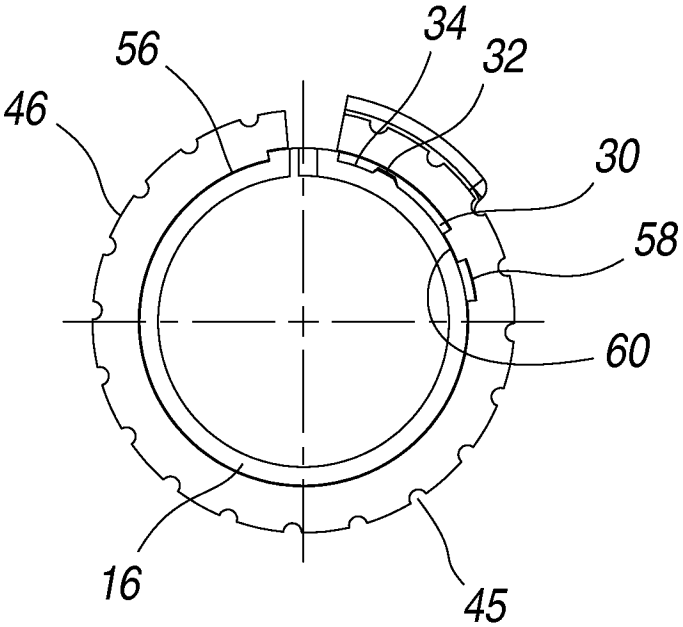
FIG. 7 is a cross sectional view cut through FIG. 5 of a touch screen wipe dispenser in an open orientation having an exposed pull portion of a wipe roll in accordance with the present invention.

With reference to FIG. 5, a pair of guide projections 24 extend from an edge of said retainer wipe slot 22 at substantially opposing ends of the wipe cylindrical tube 16. A pair of projection clearance slots 26 are formed in an opposing edge of the retainer wipe slot 22 inline with the pair of guide projections 24. A distance between each guide projection 24 is slightly greater than a width of the wipe roll 12. A distance between a top of the guide projection 24 and a bottom of the projection clearance slot 26 is equal to a width 28 of the retainer wipe slot 22. A retainer snap groove 30 is formed around substantially all of a perimeter of an opposing end of the wipe cylindrical tube 16. Each end of the retainer snap groove 30 stops short of communicating with the retainer wipe slot 22. With reference to FIG. 7, a stop projection 32 extends outward from a bottom of the retainer snap groove 30 at substantially one end of the retainer snap groove 30. The stop projection 32 is spaced from an end of the retainer snap groove 30 to create a lock cavity 34.

Figure 3:
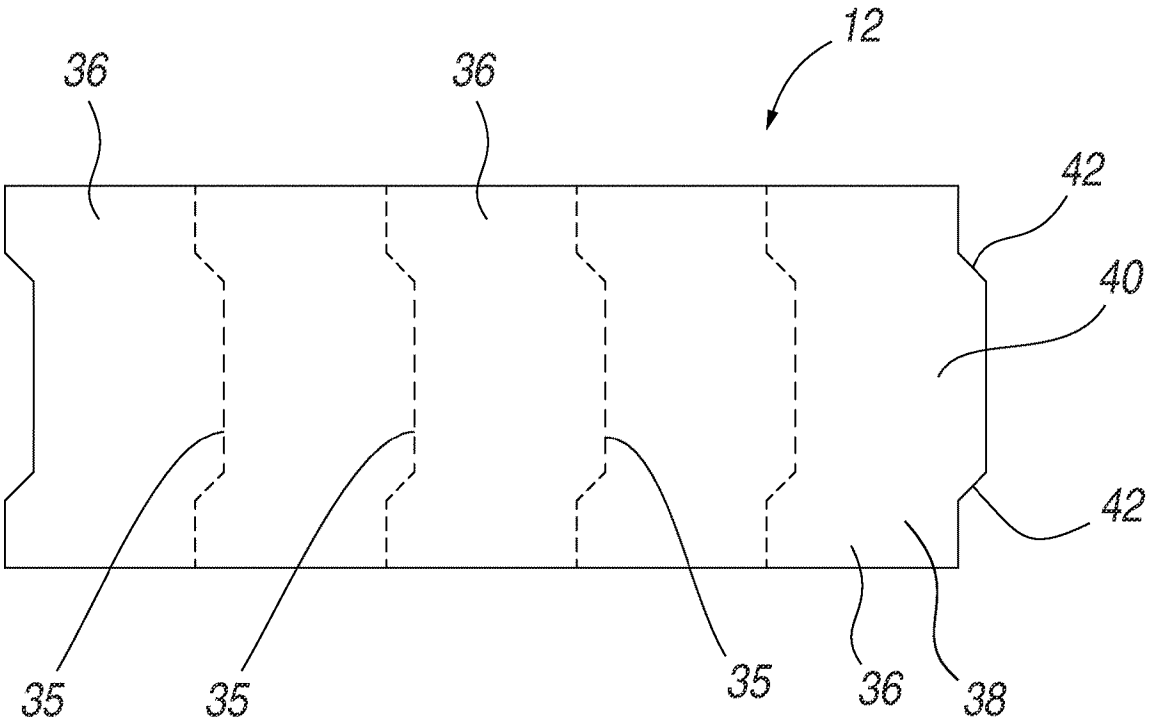
FIG. 3 is a top view of five wipe sheets of a wipe roll of a touch screen wipe dispenser in accordance with the present invention.
Figure 6:
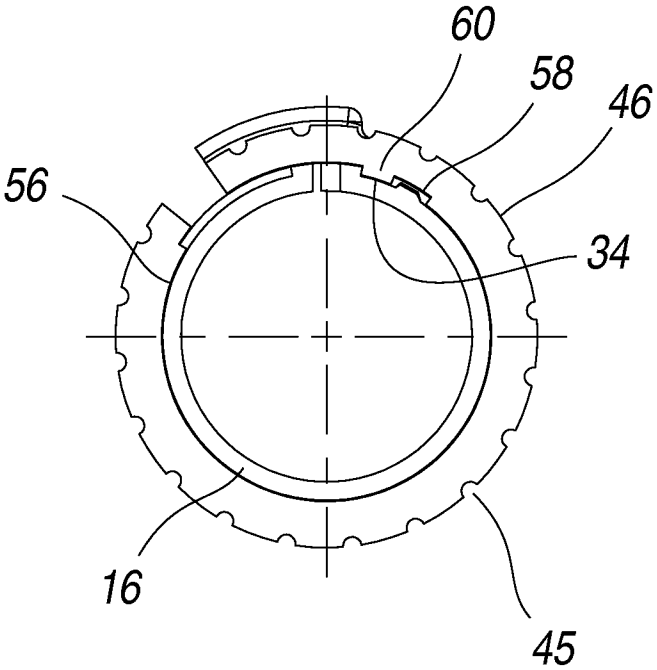
FIG. 6 is a cross sectional view cut through FIG. 4 of a touch screen wipe dispenser in a closed orientation, such that a pull portion of a wipe roll is not exposed
Figure 8:
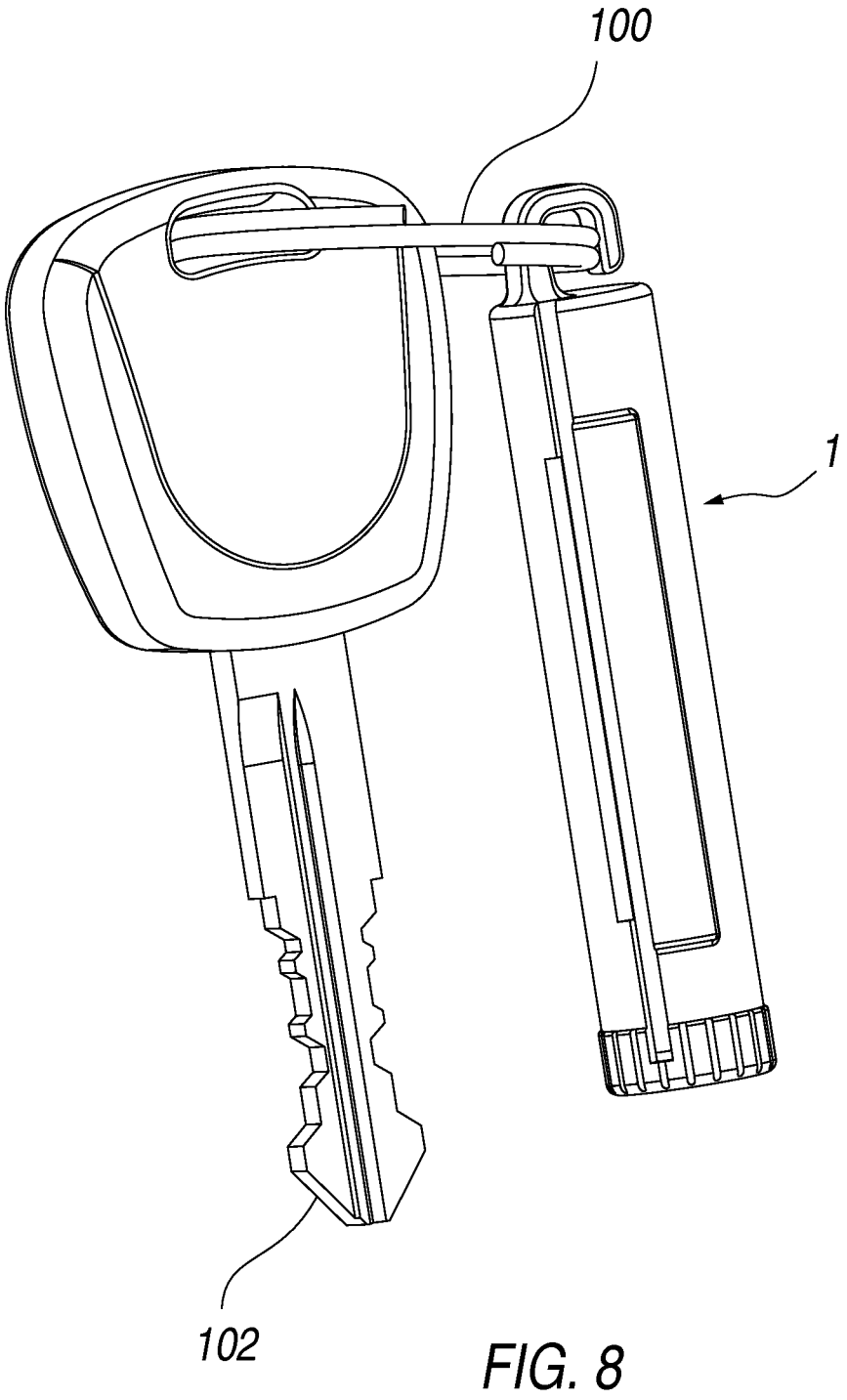
FIG. 8 is a perspective view of a touch screen wipe dispenser attached to a key chain in accordance with the present invention.

With reference to FIG. 3, the wipe roll 12 includes a plurality of wipe sheets 36, which are separated by a series of perforations 35. The shape of each wipe sheet 36 includes a pull portion 40, which extends from a wipe base 38. The pull portion 40 is located in a middle of the wipe base 38. The sides of the pull portion 40 preferably include opposing tapered surfaces 42. The wipe cover 14 includes a cover cylindrical tube 44 and a twist cap 46. One end of the cover cylindrical tube 44 is terminated with the twist cap 46. A plurality of indentations 45 or projections are preferably formed in a perimeter of the twist cap 46 for grasping with a thumb and forefinger. A cover wipe slot 48 is formed through substantially all of a length of the cover cylindrical tube 44. A wipe cover portion 50 extends upward from the cover cylindrical tube 44, adjacent the cover wipe slot 48. An inner width 52 of the wipe cover portion 50 is sized to be wider than a width of the pull portion 40. An inner height of the wipe cover portion 50 is sized to have a greater height than a thickness of a wipe sheet 36 of the wipe roll 12. A wipe pull slot 54 is formed in an opposing edge of the cover wipe slot 48, adjacent the wipe cover portion 50. A width of the wipe pull slot 54 is greater than a width of the pull portion 40. With reference to FIGS. 6-7, a retention ring 56 extends from an inner perimeter of the twist cap 46. A cover snap groove 58 is formed in the inner perimeter of the twist cap 46. The cover snap groove 58 is aligned to communicate with the retainer snap groove 30. A lock projection 60 extends from a bottom of the cover snap groove 58. With reference to FIG. 8, the touch screen wipe dispenser 1 is attached to a car key ring 100. The touch screen wipe dispenser is about the length of a car key 102.

In use, the wipe roll 12 is inserted into the wipe retainer 10. The pull portion 40 is inserted through the retainer wipe slot 22. The wipe retainer 10 with an extending pull portion 40 is aligned with the wipe cover 14, such that the pull portion 40 may be full inserted into the cover wipe slot 48 and the wipe pull slot 54. To extract a wipe sheet 36 from the touch screen wipe dispenser 1, the user grasps the key hook ring 18 and rotates the twist cap 46 relative to the key hook ring 18, such that the pull portion 40 feeds outward. The pull portion 40 is pulled from the touch screen wipe dispenser 1, which advances the wipe roll 12 for another wipe sheet 36. The wipe cover 14 may be rotated with the twist cap 46 relative to the wipe retainer 10, such that that pull portion 40 is covered with the wipe cover portion 50. The lock projection 60 of the twist cap 46 will be rotated into the lock cavity 34 of the snap groove 30.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A touch screen wipe dispenser for dispensing a roll of wipe sheets, comprising:

a wipe retainer includes a wipe cylindrical tube and a key ring hook, said key ring hook extends from one end of said wipe cylindrical tube, said wipe cylindrical tube includes an inner diameter, a retainer wipe slot is formed through substantially all of a length of said wipe cylindrical tube, a pair of guide projections extend from an edge of said retainer wipe slot at substantially opposing ends of the wipe cylindrical tube; and a wipe cover includes a cover cylindrical tube and a twist cap, said twist cap terminates one end of said cover cylindrical tube, a cover wipe slot is formed through substantially all of a length of said cover cylindrical tube, an inner perimeter of said cover cylindrical tube is sized to pivotally receive said wipe retainer, wherein a roll of wipe sheets is inserted into said inner diameter of said wipe cylindrical tube, an end of the roll of wipe sheets is inserted into said retainer wipe slot, said wipe cover with the roll of wipe sheets is inserted into said wipe cover, the end of the roll is inserted through said cover wipe slot.

2. The touch screen wipe dispenser for dispensing a roll of wipe sheets of claim 1 wherein:

each one of the wipe sheets includes a wipe base and a pull portion that extends from said wipe base.

3. The touch screen wipe dispenser for dispensing a roll of wipe sheets of claim 2 wherein:

a wipe cover portion extends upward from said cover cylindrical tube adjacent said cover wipe slot, an inner width of said wipe cover portion is sized to receive a width of the pull portion.

4. The touch screen wipe dispenser for dispensing a roll of wipe sheets of claim 3 wherein:

a wipe pull slot is formed in an edge of said cover wipe slot adjacent said wipe cover portion.

5. The touch screen wipe dispenser for dispensing a roll of wipe sheets of claim 1 wherein:

a pair of projection clearance slots are formed in an opposing edge of said retainer wipe slot inline with said pair of guide projections.

6. The touch screen wipe dispenser for dispensing a roll of wipe sheets of claim 1 wherein:

a ring gap is created between an end of said wipe retainer and an end of said key ring hook.

7. The touch screen wipe dispenser for dispensing a roll of wipe sheets of claim 1 wherein:

a plurality of indentations or projections are formed in a perimeter of said twist cap.

8. A touch screen wipe dispenser for dispensing a roll of wipe sheets, comprising:

a wipe retainer includes a wipe cylindrical tube and a key ring hook, said key ring hook extends from one end of said wipe cylindrical tube, said wipe cylindrical tube includes an inner diameter, a retainer wipe slot is formed through substantially all of a length of said wipe cylindrical tube, a retainer snap groove is formed around substantially all of an opposing end of said wipe cylindrical tube; and a wipe cover includes a cover cylindrical tube and a twist cap, said twist cap terminates one end of said cover cylindrical tube, a cover wipe slot is formed through substantially all of a length of said cover cylindrical tube, an inner perimeter of said cover cylindrical tube is sized to pivotally receive said wipe retainer, a cover snap ring extends from an inner perimeter of said twist cap, said cover snap ring is sized to pivotally engage said retainer snap groove, wherein a roll of wipe sheets is inserted into said inner diameter of said wipe cylindrical tube, said wipe cover with the roll of wipe sheets is inserted into said wipe cover.

9. The touch screen wipe dispenser for dispensing a roll of wipe sheets of claim 8 wherein:

each one of the wipe sheets includes a wipe base and a pull portion that extends from said wipe base.

10. The touch screen wipe dispenser for dispensing a roll of wipe sheets of claim 9 wherein:

a wipe cover portion extends upward from said cover cylindrical tube adjacent said cover wipe slot, an inner width of said wipe cover portion is sized to receive the pull portion.

11. The touch screen wipe dispenser for dispensing a roll of wipe sheets of claim 10 wherein:

a wipe pull slot is formed in an edge of said cover wipe slot adjacent said wipe cover portion.

12. The touch screen wipe dispenser for dispensing a roll of wipe sheets of claim 8 wherein:

a pair of guide projections extend from an edge of said retainer wipe slot at substantially opposing ends of the wipe cylindrical tube, a pair of projection clearance slots are formed in an opposing edge of said retainer wipe slot inline with said pair of guide projections.

13. The touch screen wipe dispenser for dispensing a roll of wipe sheets of claim 8 wherein:

a ring gap is created between an end of said wipe retainer and an end of said key ring hook.

14. The touch screen wipe dispenser for dispensing a roll of wipe sheets of claim 8 wherein:

a plurality of indentations or projections are formed in a perimeter of said twist cap.

15. A touch screen wipe dispenser for dispensing a roll of wipe sheets, comprising:

a wipe retainer includes a wipe cylindrical tube and a key ring hook, said key ring hook extends from one end of said wipe cylindrical tube, said wipe cylindrical tube, includes an inner diameter, a retainer wipe slot is formed through substantially all of a length of said wipe cylindrical tube, a pair of guide projections extend from an edge of said retainer wipe slot at substantially opposing ends of the wipe cylindrical tube;

a wipe roll includes a plurality of wipe sheets, said plurality of wipe sheets are separated by a series of perforations; and a wipe cover includes a cover cylindrical tube and a twist cap, said twist cap terminates one end of said cover cylindrical tube, a cover wipe slot is formed through substantially all of a length of said cover cylindrical tube, an inner perimeter of said cover cylindrical tube is sized to pivotally receive said wipe retainer, wherein said wipe roll is inserted into said inner diameter of said wipe cylindrical tube, said wipe cover with said wipe roll is inserted into said wipe cover.

16. The touch screen wipe dispenser for dispensing a roll of wipe sheets of claim 15 wherein:

each one of said plurality of wipe sheets includes a wipe base and a pull portion that extends from said wipe base.

17. The touch screen wipe dispenser for dispensing a roll of wipe sheets of claim 16 wherein:

a wipe cover portion extends upward from said cover cylindrical tube adjacent said cover wipe slot, an inner width of said wipe cover portion is sized to receive the pull portion.

18. The touch screen wipe dispenser for dispensing a roll of wipe sheets of claim 17 wherein:

a wipe pull slot is formed in an edge of said cover wipe slot adjacent said wipe cover portion.

19. The touch screen wipe dispenser for dispensing a roll of wipe sheets of claim 15 wherein:

a pair of projection clearance slots are formed in an opposing edge of said retainer wipe slot inline with said pair of guide projections.

20. The touch screen wipe dispenser for dispensing a roll of wipe sheets of claim 15 wherein:

a ring gap is created between an end of said wipe retainer and an end of said key ring hook.

* * * * *